US008235127B2

(12) United States Patent
Patel et al.

(10) Patent No.: US 8,235,127 B2
(45) Date of Patent: Aug. 7, 2012

(54) COMMUNICATING ELECTRICAL ENERGY WITH AN ELECTRICAL DEVICE IN A WELL

(75) Inventors: Dinesh R. Patel, Sugar Land, TX (US); Donald W. Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/856,049

(22) Filed: Aug. 13, 2010

(65) Prior Publication Data

US 2010/0300678 A1 Dec. 2, 2010

Related U.S. Application Data

(60) Division of application No. 11/830,025, filed on Jul. 30, 2007, now Pat. No. 7,793,718, which is a continuation-in-part of application No. 11/688,089, filed on Mar. 19, 2007, now Pat. No. 7,735,555.

(60) Provisional application No. 60/787,592, filed on Mar. 30, 2006, provisional application No. 60/745,469, filed on Apr. 26, 2006, provisional application No. 60/747,986, filed on May 23, 2006, provisional application No. 60/805,691, filed on Jun. 23, 2006, provisional application No. 60/865,084, filed on Nov. 9, 2006, provisional application No. 60/866,622, filed on Nov. 21, 2006, provisional application No. 60/867,276, filed on Nov. 27, 2006, provisional application No. 60/890,630, filed on Feb. 20, 2007.

(51) Int. Cl.
*E21B 17/02* (2006.01)
*E21B 47/12* (2006.01)

(52) U.S. Cl. ..... 166/380; 166/65.1; 166/381; 166/242.6

(58) Field of Classification Search ..... 166/66.5, 166/65.1, 242.6, 380, 381
See application file for complete search history.

(56) References Cited

U.S. PATENT DOCUMENTS

| | | | |
|---|---|---|---|
| 2,214,064 | A | 9/1940 | Niles |
| 2,379,800 | A | 7/1945 | Hare |
| 2,452,920 | A | 11/1948 | Gilbert |
| 2,470,303 | A | 5/1949 | Greenough |

(Continued)

FOREIGN PATENT DOCUMENTS

EP 795679 A2 9/1997

(Continued)

OTHER PUBLICATIONS

Brown, G.A., SPE 62952. "Using Fibre-Optic Distributed Temperature Measurements to Provide Real-Time Reservoir Surveillance Data on Wytch Farm Field Horizontal Extended-Reach Wells" Society of Petroleum Engineers Inc. 2000, pp. 1-11.

(Continued)

*Primary Examiner* — Kennth L Thompson
(74) *Attorney, Agent, or Firm* — Brandon S. Clark

(57) ABSTRACT

A completion system for use in the well includes a liner for lining the well, where the liner has a first inductive coupler portion. An electric cable extends outside an inner passage of the liner. The completion system further includes a second inductive coupler portion and an electrical device inside the liner and electrically connected to the second inductive coupler portion. The first and second inductive coupler portions enable power to be provided from the electric cable outside the inner passage of the liner to the electrical device inside the liner.

7 Claims, 3 Drawing Sheets

U.S. PATENT DOCUMENTS

| | | | | |
|---|---|---|---|---|
| 2,782,365 | A | | 2/1957 | Castel |
| 2,797,893 | A | | 7/1957 | McCune et al. |
| 2,889,880 | A | | 6/1959 | Hughes |
| 3,011,342 | A | | 12/1961 | Simm |
| 3,199,592 | A | | 8/1965 | Jacob |
| 3,206,537 | A | | 9/1965 | Steward |
| 3,344,860 | A | | 10/1967 | Voetter |
| 3,363,692 | A | | 1/1968 | Bishop |
| 3,659,259 | A | | 4/1972 | Chaney, Jr. et al. |
| 3,913,398 | A | | 10/1975 | Curtis, deceased |
| 4,027,286 | A | | 5/1977 | Marosko |
| 4,133,384 | A | | 1/1979 | Allen et al. |
| 4,241,787 | A | | 12/1980 | Price |
| 4,415,205 | A | | 11/1983 | Rehm et al. |
| 4,484,628 | A | | 11/1984 | Lanmon, II |
| 4,559,818 | A | | 12/1985 | Tsang et al. |
| 4,573,541 | A | | 3/1986 | Josse et al. |
| 4,597,290 | A | | 7/1986 | Bourdet et al. |
| 4,733,729 | A | | 3/1988 | Copeland |
| 4,806,928 | A | | 2/1989 | Veneruso |
| 4,850,430 | A | | 7/1989 | Copeland et al. |
| 4,852,648 | A | | 8/1989 | Akkerman et al. |
| 4,901,069 | A | | 2/1990 | Veneruso |
| 4,945,995 | A | | 8/1990 | Tholance et al. |
| 4,953,636 | A | | 9/1990 | Mohn |
| 4,969,523 | A | | 11/1990 | Martin et al. |
| 5,008,664 | A | | 4/1991 | More et al. |
| 5,052,941 | A | * | 10/1991 | Hernandez-Marti et al. . 439/194 |
| 5,183,110 | A | | 2/1993 | Logan et al. |
| 5,269,377 | A | | 12/1993 | Martin |
| 5,278,550 | A | | 1/1994 | Rhein-Knudsen et al. |
| 5,301,760 | A | | 4/1994 | Graham |
| 5,311,936 | A | | 5/1994 | McNair et al. |
| 5,318,121 | A | | 6/1994 | Brockman et al. |
| 5,318,122 | A | | 6/1994 | Murray et al. |
| 5,322,127 | A | | 6/1994 | McNair et al. |
| 5,325,924 | A | | 7/1994 | Bangert et al. |
| 5,330,007 | A | | 7/1994 | Collins et al. |
| 5,337,808 | A | | 8/1994 | Graham |
| 5,353,876 | A | | 10/1994 | Curington et al. |
| 5,388,648 | A | | 2/1995 | Jordan, Jr. |
| 5,398,754 | A | | 3/1995 | Dinhoble |
| 5,411,082 | A | | 5/1995 | Kennedy |
| 5,427,177 | A | | 6/1995 | Jordan, Jr. et al. |
| 5,435,392 | A | | 7/1995 | Kennedy |
| 5,439,051 | A | | 8/1995 | Kennedy et al. |
| 5,454,430 | A | | 10/1995 | Kennedy et al. |
| 5,455,573 | A | | 10/1995 | Delatorre |
| 5,457,988 | A | | 10/1995 | Delatorre |
| 5,458,199 | A | | 10/1995 | Collins et al. |
| 5,458,209 | A | | 10/1995 | Hayes et al. |
| 5,462,120 | A | | 10/1995 | Gondouin |
| 5,472,048 | A | | 12/1995 | Kennedy et al. |
| 5,474,131 | A | | 12/1995 | Jordan, Jr. et al. |
| 5,477,923 | A | | 12/1995 | Jordan, Jr. et al. |
| 5,477,925 | A | | 12/1995 | Trahan et al. |
| 5,499,680 | A | | 3/1996 | Walter et al. |
| 5,520,252 | A | | 5/1996 | McNair |
| 5,521,592 | A | | 5/1996 | Veneruso |
| 5,533,573 | A | | 7/1996 | Jordan, Jr. et al. |
| 5,542,472 | A | | 8/1996 | Pringle et al. |
| 5,597,042 | A | | 1/1997 | Tubel et al. |
| 5,655,602 | A | | 8/1997 | Collins |
| 5,680,901 | A | | 10/1997 | Gardes |
| 5,697,445 | A | | 12/1997 | Graham |
| 5,706,896 | A | | 1/1998 | Tubel et al. |
| 5,730,219 | A | | 3/1998 | Tubel et al. |
| 5,823,263 | A | | 10/1998 | Morris et al. |
| 5,831,156 | A | | 11/1998 | Mullins |
| 5,871,047 | A | | 2/1999 | Spath et al. |
| 5,871,052 | A | | 2/1999 | Benson et al. |
| 5,875,847 | A | | 3/1999 | Forsyth |
| 5,915,474 | A | | 6/1999 | Buytaert et al. |
| 5,918,669 | A | | 7/1999 | Morris et al. |
| 5,941,307 | A | | 8/1999 | Tubel |
| 5,941,308 | A | | 8/1999 | Malone et al. |
| 5,944,107 | A | | 8/1999 | Ohmer |
| 5,944,108 | A | | 8/1999 | Baugh et al. |
| 5,944,109 | A | | 8/1999 | Longbottom |
| 5,945,923 | A | | 8/1999 | Soulier |
| 5,954,134 | A | | 9/1999 | Longbottom |
| 5,959,547 | A | | 9/1999 | Tubel et al. |
| 5,960,873 | A | | 10/1999 | Alexander et al. |
| 5,967,816 | A | | 10/1999 | Sampa et al. |
| 5,971,072 | A | | 10/1999 | Huber et al. |
| 5,975,204 | A | | 11/1999 | Tubel et al. |
| 5,979,559 | A | | 11/1999 | Kennedy |
| 5,992,519 | A | | 11/1999 | Ramakrishnan et al. |
| 6,003,606 | A | | 12/1999 | Moore et al. |
| 6,006,832 | A | | 12/1999 | Tubel et al. |
| 6,035,937 | A | | 3/2000 | Gano et al. |
| 6,046,685 | A | | 4/2000 | Tubel |
| 6,061,000 | A | | 5/2000 | Edwards |
| 6,065,209 | A | | 5/2000 | Gondouin |
| 6,065,543 | A | | 5/2000 | Gano et al. |
| 6,073,697 | A | | 6/2000 | Parlin et al. |
| 6,076,046 | A | | 6/2000 | Vasudevan et al. |
| 6,079,488 | A | | 6/2000 | Begg et al. |
| 6,079,494 | A | | 6/2000 | Longbottom et al. |
| 6,119,780 | A | | 9/2000 | Christmas |
| 6,125,937 | A | | 10/2000 | Longbottom et al. |
| 6,173,772 | B1 | | 1/2001 | Vaynshteyn |
| 6,173,788 | B1 | | 1/2001 | Lembcke et al. |
| 6,176,308 | B1 | | 1/2001 | Pearson |
| 6,176,312 | B1 | | 1/2001 | Tubel et al. |
| 6,192,980 | B1 | | 2/2001 | Tubel et al. |
| 6,192,988 | B1 | | 2/2001 | Tubel |
| 6,196,312 | B1 | | 3/2001 | Collins et al. |
| 6,209,648 | B1 | | 4/2001 | Ohmer et al. |
| 6,244,337 | B1 | | 6/2001 | Cumming et al. |
| 6,286,595 | B1 | * | 9/2001 | Oxnevad et al. ..... 166/242.7 |
| 6,302,203 | B1 | | 10/2001 | Rayssiguier et al. |
| 6,305,469 | B1 | | 10/2001 | Coenen et al. |
| 6,310,559 | B1 | | 10/2001 | Laborde et al. |
| 6,318,469 | B1 | | 11/2001 | Patel |
| 6,328,111 | B1 | | 12/2001 | Bearden et al. |
| 6,349,770 | B1 | | 2/2002 | Brooks et al. |
| 6,354,378 | B1 | | 3/2002 | Patel |
| 6,360,820 | B1 | | 3/2002 | Laborde et al. |
| 6,374,913 | B1 | | 4/2002 | Robbins et al. |
| 6,378,610 | B2 | | 4/2002 | Rayssiguier et al. |
| 6,415,864 | B1 | | 7/2002 | Ramakrishnan et al. |
| 6,419,022 | B1 | | 7/2002 | Jernigan et al. |
| 6,457,522 | B1 | | 10/2002 | Bangash et al. |
| 6,481,494 | B1 | | 11/2002 | Dusterhoft et al. |
| 6,510,899 | B1 | | 1/2003 | Sheiretov et al. |
| 6,513,599 | B1 | | 2/2003 | Bixenman et al. |
| 6,515,592 | B1 | | 2/2003 | Babour et al. |
| 6,533,039 | B2 | | 3/2003 | Rivas et al. |
| 6,568,469 | B2 | | 5/2003 | Ohmer et al. |
| 6,577,244 | B1 | | 6/2003 | Clark et al. |
| 6,588,507 | B2 | | 7/2003 | Dusterhoft et al. |
| 6,614,229 | B1 | | 9/2003 | Clark et al. |
| 6,614,716 | B2 | | 9/2003 | Plona et al. |
| 6,618,677 | B1 | | 9/2003 | Brown |
| 6,668,922 | B2 | | 12/2003 | Ziauddin et al. |
| 6,675,892 | B2 | | 1/2004 | Kuchuk et al. |
| 6,679,324 | B2 | | 1/2004 | Den Boer et al. |
| 6,681,861 | B2 | * | 1/2004 | Davidson et al. ..... 166/382 |
| 6,684,952 | B2 | * | 2/2004 | Brockman et al. ..... 166/250.03 |
| 6,695,052 | B2 | | 2/2004 | Branstetter et al. |
| 6,702,015 | B2 | | 3/2004 | Fielder, III et al. |
| 6,727,827 | B1 | | 4/2004 | Edwards et al. |
| 6,749,022 | B1 | | 6/2004 | Fredd |
| 6,751,556 | B2 | | 6/2004 | Schroeder et al. |
| 6,758,271 | B1 | | 7/2004 | Smith |
| 6,766,857 | B2 | | 7/2004 | Bixenman |
| 6,768,700 | B2 | | 7/2004 | Veneruso et al. |
| 6,776,256 | B2 | | 8/2004 | Kostyuchenko et al. |
| 6,787,758 | B2 | | 9/2004 | Tubel et al. |
| 6,789,621 | B2 | | 9/2004 | Wetzel et al. |
| 6,789,937 | B2 | | 9/2004 | Haddad et al. |
| 6,817,410 | B2 | | 11/2004 | Wetzel et al. |
| 6,828,547 | B2 | | 12/2004 | Tubel et al. |
| 6,837,310 | B2 | | 1/2005 | Martin |
| 6,842,700 | B2 | | 1/2005 | Poe |
| 6,845,819 | B2 | | 1/2005 | Barrett et al. |

| | | | |
|---|---|---|---|
| 6,848,510 | B2 | 2/2005 | Bixenman et al. |
| 6,856,255 | B2 | 2/2005 | Chalitsios et al. |
| 6,857,475 | B2 | 2/2005 | Johnson |
| 6,863,127 | B2 | 3/2005 | Clark et al. |
| 6,863,129 | B2 | 3/2005 | Ohmer et al. |
| 6,864,801 | B2 | 3/2005 | Tabanou et al. |
| 6,866,306 | B2 | 3/2005 | Boyle |
| 6,873,267 | B1 | 3/2005 | Tubel |
| 6,896,074 | B2 | 5/2005 | Cook et al. |
| 6,903,660 | B2 | 6/2005 | Clark et al. |
| 6,911,418 | B2 | 6/2005 | Frenier |
| 6,913,083 | B2 | 7/2005 | Smith |
| 6,915,848 | B2 | 7/2005 | Thomeer |
| 6,920,395 | B2 | 7/2005 | Brown |
| 6,942,033 | B2 | 9/2005 | Brooks et al. |
| 6,943,340 | B2 | 9/2005 | Tubel |
| 6,950,034 | B2 | 9/2005 | Pacault et al. |
| 6,975,243 | B2 | 12/2005 | Clark et al. |
| 6,978,833 | B2 | 12/2005 | Salamitou et al. |
| 6,980,940 | B1 | 12/2005 | Gurpinar et al. |
| 6,983,796 | B2 | 1/2006 | Bayne et al. |
| 6,989,764 | B2 | 1/2006 | Thomeer et al. |
| 7,000,696 | B2 | 2/2006 | Harkins |
| 7,000,697 | B2 | 2/2006 | Goode et al. |
| 7,004,252 | B2 | 2/2006 | Vise |
| 7,007,756 | B2 | 3/2006 | Lerche et al. |
| 7,040,402 | B2 | 5/2006 | Vercaemer |
| 7,040,415 | B2 | 5/2006 | Boyle et al. |
| 7,055,604 | B2 | 6/2006 | Jee et al. |
| 7,063,143 | B2 | 6/2006 | Tilton et al. |
| 7,079,952 | B2 | 7/2006 | Thomas et al. |
| 7,083,452 | B2 | 8/2006 | Eriksson et al. |
| 7,093,661 | B2 | 8/2006 | Olsen |
| 7,096,092 | B1 | 8/2006 | Ramakrishnan |
| 7,222,676 | B2 | 5/2007 | Patel |
| 2001/0013410 | A1 | 8/2001 | Beck et al. |
| 2002/0007948 | A1 | 1/2002 | Bayne et al. |
| 2002/0050361 | A1 | 5/2002 | Shaw et al. |
| 2002/0096333 | A1 | 7/2002 | Johnson et al. |
| 2002/0112857 | A1 | 8/2002 | Ohmer et al. |
| 2003/0137302 | A1 | 7/2003 | Clark et al. |
| 2003/0137429 | A1 | 7/2003 | Clark et al. |
| 2003/0141872 | A1 | 7/2003 | Clark et al. |
| 2003/0150622 | A1 | 8/2003 | Patel et al. |
| 2003/0221829 | A1 | 12/2003 | Patel et al. |
| 2004/0010374 | A1 | 1/2004 | Raghuraman et al. |
| 2004/0094303 | A1 | 5/2004 | Brockman et al. |
| 2004/0164838 | A1 | 8/2004 | Hall et al. |
| 2004/0173350 | A1 | 9/2004 | Wetzel et al. |
| 2004/0173352 | A1 | 9/2004 | Mullen et al. |
| 2004/0194950 | A1 | 10/2004 | Restarick et al. |
| 2004/0238168 | A1 | 12/2004 | Echols |
| 2005/0070143 | A1 | 3/2005 | Eriksson et al. |
| 2005/0072564 | A1 | 4/2005 | Grigsby et al. |
| 2005/0074210 | A1 | 4/2005 | Grigsby et al. |
| 2005/0083064 | A1 | 4/2005 | Homan et al. |
| 2005/0087368 | A1 | 4/2005 | Boyle et al. |
| 2005/0092488 | A1 | 5/2005 | Rodet et al. |
| 2005/0092501 | A1 | 5/2005 | Chavers et al. |
| 2005/0115741 | A1 | 6/2005 | Terry et al. |
| 2005/0149264 | A1 | 7/2005 | Tarvin et al. |
| 2005/0168349 | A1 | 8/2005 | Huang et al. |
| 2005/0178554 | A1 | 8/2005 | Hromas et al. |
| 2005/0194150 | A1 | 9/2005 | Ringgenberg |
| 2005/0199401 | A1 | 9/2005 | Patel et al. |
| 2005/0236161 | A1 | 10/2005 | Gay et al. |
| 2005/0274513 | A1 | 12/2005 | Schultz et al. |
| 2005/0279510 | A1 | 12/2005 | Patel et al. |
| 2006/0000604 | A1 | 1/2006 | Jenkins et al. |
| 2006/0000618 | A1 | 1/2006 | Cho et al. |
| 2006/0006656 | A1 | 1/2006 | Smedstad |
| 2006/0016593 | A1 | 1/2006 | Gambier |
| 2006/0042795 | A1 | 3/2006 | Richards |
| 2006/0060352 | A1 | 3/2006 | Vidrine et al. |
| 2006/0065444 | A1 | 3/2006 | Hall et al. |
| 2006/0077757 | A1 | 4/2006 | Cox et al. |
| 2006/0086498 | A1 | 4/2006 | Wetzel et al. |
| 2006/0090892 | A1 | 5/2006 | Wetzel et al. |
| 2006/0090893 | A1 | 5/2006 | Sheffield |
| 2006/0124297 | A1 | 6/2006 | Ohmer |
| 2006/0124318 | A1 | 6/2006 | Sheffield |
| 2006/0162934 | A1 | 7/2006 | Shepler |
| 2006/0196660 | A1 | 9/2006 | Patel |
| 2006/0225926 | A1 | 10/2006 | Madhavan et al. |
| 2006/0254767 | A1 | 11/2006 | Pabon et al. |
| 2006/0283606 | A1 | 12/2006 | Partouche et al. |
| 2007/0012436 | A1 | 1/2007 | Freyer |
| 2007/0027245 | A1 | 2/2007 | Vaidya et al. |
| 2007/0044964 | A1 | 3/2007 | Grigar et al. |
| 2007/0059166 | A1 | 3/2007 | Sheth et al. |
| 2007/0062710 | A1 | 3/2007 | Pelletier et al. |
| 2007/0074872 | A1 | 4/2007 | Du et al. |
| 2007/0107907 | A1 | 5/2007 | Smedstad et al. |
| 2007/0110593 | A1 | 5/2007 | Sheth et al. |
| 2007/0116560 | A1 | 5/2007 | Eslinger |
| 2007/0142547 | A1 | 6/2007 | Vaidya et al. |
| 2007/0144738 | A1 | 6/2007 | Sugiyama et al. |
| 2007/0144746 | A1 | 6/2007 | Jonas |
| 2007/0151724 | A1 | 7/2007 | Ohmer et al. |
| 2007/0159351 | A1 | 7/2007 | Madhavan et al. |
| 2007/0162235 | A1 | 7/2007 | Zhan et al. |
| 2007/0165487 | A1 | 7/2007 | Nutt et al. |
| 2007/0199696 | A1 | 8/2007 | Walford |
| 2007/0213963 | A1 | 9/2007 | Jalali et al. |
| 2007/0216415 | A1 | 9/2007 | Clark et al. |
| 2007/0227727 | A1 | 10/2007 | Patel et al. |
| 2007/0235185 | A1 | 10/2007 | Patel et al. |
| 2007/0271077 | A1 | 11/2007 | Kosmala et al. |

FOREIGN PATENT DOCUMENTS

| | | | |
|---|---|---|---|
| EP | 823534 | A1 | 2/1998 |
| EP | 1158138 | A2 | 11/2001 |
| EP | 0786578 | B1 | 12/2005 |
| GB | 2274864 | A | 8/1994 |
| GB | 2304764 | A | 3/1997 |
| GB | 2333545 | A | 7/1999 |
| GB | 2337780 | A | 12/1999 |
| GB | 2345137 | A | 6/2000 |
| GB | 2360532 | A | 9/2001 |
| GB | 2364724 | A | 2/2002 |
| GB | 2376488 | A | 12/2002 |
| GB | 2381281 | A | 4/2003 |
| GB | 2392461 | A | 3/2004 |
| GB | 2395315 | A | 5/2004 |
| GB | 2395965 | A | 6/2004 |
| GB | 2401385 | A | 11/2004 |
| GB | 2401430 | A | 11/2004 |
| GB | 2401889 | A | 11/2004 |
| GB | 2404676 | A | 2/2005 |
| GB | 2407334 | A | 4/2005 |
| GB | 2408327 | A | 5/2005 |
| GB | 2409692 | A | 7/2005 |
| GB | 2416871 | A | 2/2006 |
| GB | 2419619 | A | 5/2006 |
| GB | 2419903 | A | 5/2006 |
| GB | 2426019 | A | 11/2006 |
| GB | 2428787 | A | 2/2007 |
| RU | 2136856 | C1 | 9/1999 |
| RU | 2146759 | C1 | 3/2000 |
| RU | 2171363 | C1 | 7/2001 |
| RU | 2239041 | C2 | 10/2004 |
| WO | 9623953 | A1 | 8/1996 |
| WO | 9850680 | A2 | 11/1998 |
| WO | 9850680 | A3 | 11/1998 |
| WO | 9858151 | A1 | 12/1998 |
| WO | 9913195 | A1 | 3/1999 |
| WO | 0029713 | A2 | 5/2000 |
| WO | 0171155 | A1 | 9/2001 |
| WO | 0198632 | A1 | 12/2001 |
| WO | 03023185 | A1 | 3/2003 |
| WO | 2004076815 | A1 | 9/2004 |
| WO | 2004094961 | A1 | 11/2004 |
| WO | 2005035943 | A1 | 4/2005 |
| WO | 2005064116 | A1 | 7/2005 |
| WO | 2006010875 | A1 | 2/2006 |

OTHER PUBLICATIONS

Saputelli, L. et al. "Real-Time Decision-making for Value Creation while Drilling" SPE/IADC Middle East Drilling Technology Conference & Exhibition, Oct. 2003.

Lanier et al. "Brunei Field Trial of a Fibre Optic Distributed Temperature Sensor (DTS) System in 1,DOOm Open Hole Horizontal Oil Producer" SPE 84324; SPE Annual Technical Conference and Exhibition, Oct. 5-8, 2003.

* cited by examiner

COMMUNICATING ELECTRICAL ENERGY WITH AN ELECTRICAL DEVICE IN A WELL

CROSS-REFERENCE TO RELATED APPLICATIONS

This application is a divisional of U.S. Ser. No. 11/830,025, filed Jul. 30, 2007, which is a continuation-in-part of U.S. Patent Application entitled "Completion System Having a Sand Control Assembly, an Inductive Coupler, and a Sensor Proximate the Sand Control Assembly,", filed Mar. 19, 2007, U.S. Ser. No. 11/688,089, now U.S. Pat. No. 7,735,555, issued Jun. 15, 2010, which claims the benefit under 35 U.S.C. §119(e) of the following provisional patent applications: U.S. Ser. No. 60/787,592, entitled "Method for Placing Sensor Arrays in the Sand Face Completion," filed Mar. 30, 2006; U.S. Ser. No. 60/745,469, entitled "Method for Placing Flow Control in a Temperature Sensor Array Completion," filed Apr. 24, 2006; U.S. Ser. No. 60/747,986, entitled "A Method for Providing Measurement System During Sand Control Operation and Then Converting It to Permanent Measurement System," filed May 23, 2006; U.S. Ser. No. 60/805,691, entitled "Sand Face Measurement System and Re-Closeable Formation Isolation Valve in ESP Completion," filed Jun. 23, 2006; U.S. Ser. No. 60/865,084, entitled "Welded, Purged and Pressure Tested Permanent Downhole Cable and Sensor Array," filed Nov. 9, 2006; U.S. Ser. No. 60/866,622, entitled "Method for Placing Sensor Arrays in the Sand Face Completion," filed Nov. 21, 2006; U.S. Ser. No. 60/867,276, entitled "Method for Smart Well," filed Nov. 27, 2006; and U.S. Ser. No. 60/890,630, entitled "Method and Apparatus to Derive Flow Properties Within a Wellbore," filed Feb. 20, 2007. Each of the above applications is hereby incorporated by reference.

TECHNICAL FIELD

The invention relates to communicating electrical energy with an electrical device in a well.

BACKGROUND

A completion system is installed in a well to produce hydrocarbons (or other types of fluids) from reservoir(s) adjacent the well, or to inject fluids into the well. In many completion systems, electrical devices, such as sensors, flow control valves, and so forth, are provided in the well. Such completion systems are sometimes referred to as "intelligent completion systems." An issue associated with deployment of electrical devices in a well is the ability to efficiently communicate power and/or data with such electrical devices once they are deployed in the well.

SUMMARY

In general, according to an embodiment, a completion system for use in a well includes a liner for lining the well, where the liner has a first inductive coupler portion. An electric cable extends outside an inner passage of the liner, and an electrical device is positioned inside the liner and is electrically connected to a second inductive coupler portion. The second inductive coupler portion is positioned proximate the first inductive coupler portion to enable power to be provided from the electric cable outside the inner passage of the liner to the electrical device inside the liner.

In general, according to another embodiment, a completion system for use in a well includes a tubing to provide flow of fluid to or from an earth surface from which the well extends. The tubing has a housing defining a longitudinal bore embedded inside the housing. An electric cable extends in the longitudinal bore, and an electrical device is positioned in the well. An inductive coupler communicates electrical energy between the electric cable and the electrical device.

Other or alternative features will become apparent from the following description, from the drawings, and from the claims.

DETAILED DESCRIPTION

Figure 1:
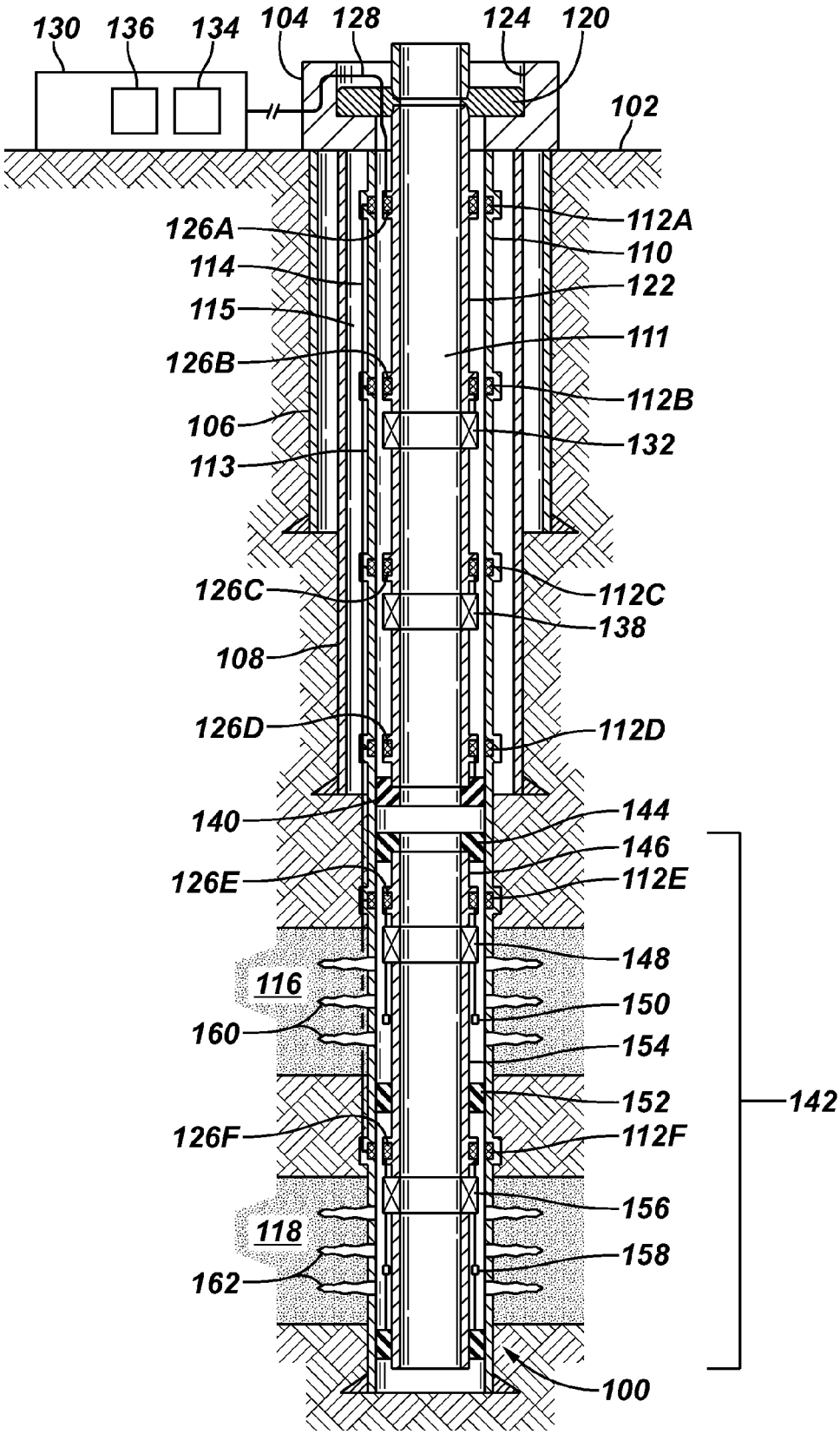
FIG. 1 illustrates an arrangement of a completion system, according to an embodiment.

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a technique of providing power and communicating data with an electrical device provided in a well involves using a liner (e.g., a casing that lines a main portion of a well, or a liner that lines some other portion of the well) that has inductive coupler portions. In one embodiment, an electric cable (or multiple electric cables) is (are) run outside an inner passage of the liner. The "inner passage" of the liner refers to the region surrounded by the liner, in which various completion components can be positioned. In some implementations, the liner is generally shaped as a cylinder that has an inner longitudinal bore; in such implementations, the inner longitudinal bore is considered the inner passage. In other implementations, the liner can have a non-cylindrical shape.

An electric cable is considered to be "outside the inner passage of the liner" if the electric cable runs along the outer surface (whether or not the electric cable is touching the outer surface of the liner) or if the electric cable is embedded within the housing of the liner. The electric cable outside the inner passage of the liner is electrically connected to inductive coupler portions that are part of the liner. The electric cable is able to carry both power and data.

The power carried on the electric cable can be communicated through at least one of the inductive coupler portions that are part of the liner to a corresponding inductive coupler portion located inside the liner, where the inductive coupler portion inside the liner is electrically connected to at least one electrical device (e.g., a sensor, flow control valve, etc.) that is also located inside the liner. In this manner, power provided on an electric cable outside the inner passage of the liner can be communicated (by induction through corresponding inductive coupler portions) to an electrical device that is located inside the liner.

Also, data (e.g., commands or measurement data) can be communicated through an inductive coupler between the electric cable (outside the inner passage of the liner) and the electrical device (inside the liner). More generally, electrical energy can be communicated between the electric cable and electrical device through an inductive coupler, where the "electrical energy" refers to power and/or data.

An electrical device is considered to be "inside" the liner if the electrical device is positioned within the inner passage of the liner. Note that the electrical device is also considered to be inside the liner if the electrical device is attached to the liner, so long as the electrical device has access to or is otherwise exposed to the inner passage of the liner.

Induction (for coupling electrical energy between inductive coupler portions) is used to indicate transference of a time-changing electromagnetic signal or power that does not rely upon a closed electrical circuit, but instead includes a component that is wireless. For example, if a time-changing current is passed through a coil, then a consequence of the time variation is that an electromagnetic field will be generated in the medium surrounding the coil. If a second coil is placed into that electromagnetic field, then a voltage will be generated on that second coil, which we refer to as the induced voltage. The efficiency of this inductive coupling increases as the coils are placed closer, but this is not a necessary constraint. For example, if time-changing current is passed through a coil is wrapped around a metallic mandrel, then a voltage will be induced on a coil wrapped around that same mandrel at some distance displaced from the first coil. In this way, a single transmitter can be used to power or communicate with multiple sensors along the wellbore. Given enough power, the transmission distance can be very large. For example, solenoidal coils on the surface of the earth can be used to inductively communicate with subterranean coils deep within a wellbore. Also note that the coils do not have to be wrapped as solenoids. Another example of inductive coupling occurs when a coil is wrapped as a toroid around a metal mandrel, and a voltage is induced on a second toroid some distance removed from the first.

In another embodiment, instead of running the electric cable outside the inner passage of the liner, an electric cable can be embedded in the housing of a tubing or pipe that is deployed in the well to allow communication with the electrical device that is also deployed in the well. A tubing or pipe that has an electric cable embedded in the housing of the tubing or pipe is referred to as a wired tubing or wired pipe. An inductive coupler can be used to communicate electrical energy between the wired tubing or pipe and the electrical device. Note that the terms "tubing" and "pipe" are used interchangeably.

Although reference is made to "liner," "casing," "tubing," or "pipe" in the singular sense, the liner, casing, tubing, or pipe can actually include multiple discrete sections that are connected together. For example, a liner, casing, tubing, or pipe is usually installed in the well one section at a time, with the sections connected during installation. In other cases, certain types of liner, casing, tubing, or pipe can be run in as a continuous structure.

FIG. 1 illustrates an embodiment of a completion system that is deployed in a well 100. At the earth surface 102 from which the well 100 extends, wellhead equipment 104 is provided. A first casing 106 extends from the wellhead equipment 104 and is provided to line a first section of the well 100. A second casing 108 that has a diameter smaller than the first casing 106 also extends from the wellhead equipment 104 and is deployed inside the first casing 106 to line a second section of the well 100. In addition, a third casing 110 that has a smaller diameter than the second casing 108 is installed inside the second casing and lines a third section of the well 100. The third casing 110 also extends from the wellhead equipment 104.

Note that, in the example arrangement of FIG. 1, the third section lined by the third casing 110 is longer in length than the second section lined by the second casing 108, which in turn is longer in length than the first section of the well lined by the first casing 106. In other implementations, the first and second casings 106, 108 can be omitted.

Although reference is made to "casing" in the ensuing discussion, it is noted that techniques according to some embodiments can be applied to other types of liners, including liners that line other parts of a well.

The third casing 110 has first inductive coupler portions 112 (112A, 112B, 112C, 112D, 112E, and 112F shown), which can be female inductive coupler portions. An electric cable 114 interconnects the inductive coupler portions 112. The electric cable 114 extends outside the third casing 110. The electric cable 114 runs in a longitudinal direction of the third casing 110 along an outer surface 113 of the third casing 110. The electric cable 114 can be touching the outer surface 113, or the electric cable 114 can be spaced apart from the outer surface 113. Alternatively, a longitudinal groove can be formed in the outer surface 113 of the third casing 110, with the electric cable 114 positioned in the longitudinal groove. The electric cable 114 of FIG. 1 extends through or is otherwise exposed to a cement layer that cements the third casing 110 to the well. A portion of the electric cable 114 is in an annulus region 115 between the second casing 108 and the third casing 110.

The third casing 110 defines an inner passage 111, where completion equipment that can be deployed in the inner passage 111 of the casing 110 includes a tubing string having a tubing 122. As further depicted in FIG. 1, a lower completion section 142 can also be deployed in the inner passage 111 of the casing 110.

A tubing hanger 120 attached to the tubing string is located in a receptacle 124 of the wellhead equipment 104. The tubing hanger 120 is used to hang the tubing string in the well 100.

The tubing 122 also includes second inductive coupler portions 126 (126A, 126B, 126C, 126D depicted in FIG. 1), which can be male inductive coupler portions. The lower completion section 142 deployed below the tubing string also includes second inductive coupler portions 126 (126E and 126F shown). The second inductive coupler portions 126 are for positioning adjacent corresponding first inductive coupler portions 112 that are part of the third casing 110. Each corresponding pair of a first inductive coupler portion 112 and a second inductive coupler portion 126 forms an inductive coupler that allows for communication of electrical energy (power and/or data) between devices electrically connected to respective first and second inductive coupler portions 112, 126.

For example, as depicted in FIG. 1, the uppermost second inductive coupler portion 126A is connected by an electric cable 128 that extends upwardly from the inductive coupler portion 126A through the tubing hanger 120 to a surface controller 130 located somewhere on the earth surface 102. The surface controller 130 can include both power equipment 134 and processing equipment 136, where the power equipment 134 is used to provide power to downhole devices, and the processing equipment 136 is used to control downhole devices or to receive data from downhole devices. Electrical energy is communicated between the surface controller 130 and the electric cable 114 outside the third casing 110 through the electric cable 128 and the inductive coupler formed from portions 112A, 126A.

One of the electrical devices provided inside the third casing 110 is a safety valve 132 that is part of the tubing 122. The safety valve 132 can be closed to shut-in the well 100 in case of a safety problem. The safety valve 132 can also be closed to stop flow of fluids for other purposes. In some implementations, the safety valve 132 can be a flapper valve. Alternatively, the safety valve 132 can be a ball valve or some other type of valve.

Note that the safety valve 132 is electrically connected to another second inductive coupler portions 126B. The safety valve 132 is activatable by issuing a command from the surface controller 130 through the electric cable 128 to the uppermost second inductive coupler portion 126A. The uppermost second inductive coupler portion 126A then couples the command through the corresponding first inductive coupler portion 112A to the electric cable 114, which communicates the command to the inductive coupler (112B, 126B) that is electrically connected to the safety valve 132. The command activates (opens or closes) the safety valve 132. Note that the power equipment 134 of the surface controller 130 also supplies power through the electric cable 128, inductive couplers (112A, 126A, 112B, 126B), and electric cable 114 to the safety valve 132.

FIG. 1 also shows a sensor assembly 138 (another electrical device inside the third casing 110) that is electrically connected to the second inductive coupler portion 126C. The sensor assembly 138, which is part of the tubing 122, can include a pressure sensor and/or a temperature sensor. Alternatively, the sensor assembly 138 can include other types of sensors.

Again, electrical energy from the surface controller 130 can be provided through the inductive coupler portions 112A, 126A, the electric cable 114, and the inductive coupler portions 112C, 126C to the sensor assembly 138. Measurement data collected by the sensor assembly 138 can also be communicated through the inductive coupler portions 112C, 126C to the electric cable 114, which in turn is coupled through inductive coupler portions 112A, 126A to the electric cable 128 that extends to the surface controller 130.

At its lower end, the tubing string includes a production packer 140 that is connected to the tubing 122. The production packer 140 is another electrical device inside the third casing 110 that is powered through the electric cable 114 by the surface controller 130. The production packer 140 can also be set by electrical activation in response to a command from the surface controller 130. Setting the production packer 140 causes the packer to seal against the inner wall of the casing 110.

The production packer 140 is electrically connected to second inductive coupler portion 126D. Electrical energy can be inductively coupled from the electric cable 114 through inductive coupler portions 112D, 126D to the production packer 140.

The tubing string including the tubing 122 and production packer 140 is part of an upper completion section of the completion system that is installed inside the third casing 110. The completion system further includes the lower completion section 142, which is positioned below the production packer 140 of the tubing string. The lower completion section 142 includes a lower completion packer 144. Below the lower completion packer 144 is a pipe section 146 that has second inductive coupler portion 126E. The inductive coupler portion 126E is positioned adjacent the first inductive coupler portion 112E. The second inductive coupler portion 126E is electrically connected to a flow control valve 148 and a sensor assembly 150. Electrical energy can be coupled, through inductive coupler portions 112E, 126E, between the electric cable 114 and the flow control valve 148 and the sensor assembly 150. For example, a command can be sent to activate (open or close) the flow control valve 148, and measurement data can be sent from the sensor assembly 150 through the inductive coupler portions 112E, 126E to the electric cable 114.

The lower completion section 142 further includes an isolation packer 152 for isolating an upper zone 116 from a lower zone 118. The upper and lower zones 116 and 118 correspond to different parts of a reservoir (or to different reservoirs) through which the well 100 extends. Fluids can be produced from, or injected into, the different zones 116, 118.

The lower completion section 142 also includes a sand control assembly 154 that is provided to perform particulate control (such as sand control) in the upper and lower zones 116, 118. In one example, the sand control assembly 154 can be a sand screen that allows inflow of fluids but blocks inflow of particulates such as sand. As further depicted in FIG. 1, perforations 160 and 162 are formed in respective upper and lower zones 116, 118.

The sensor assembly 150 is positioned in the upper zone 116 above the isolation packer 152. The sensor assembly 150 can thus be used to make measurements with respect to the upper zone 116. The flow control valve 148 is used to control flow in the upper zone 116, such as to control radial flow between the inner longitudinal bore of the tubing string and the surrounding reservoir.

In the lower zone 118, the lower completion section 142 includes a second inductive coupler portion 126F that is positioned adjacent the first inductive coupler portion 112F that is part of the third casing 110. The inductive coupler portion 126F is electrically connected to a flow control valve 156 and a sensor assembly 158 (both located in the lower zone 118). Electrical energy can be coupled between the electric cable 114 and the flow control valve 156/sensor assembly 158 through the inductive coupler portions 112F, 126F.

By using the equipment depicted in FIG. 1, an electric cable does not have to be run inside the third casing 110, which reduces the risk of damage to the electric cable when other completion components are being installed. By providing multiple first inductive coupler portions 112 along the length of the third casing 110, a convenient and efficient mechanism is provided to allow the delivery of electrical energy between the electric cable 114 that is outside the casing 110 with electrical devices that are deployed inside the casing 110.

In operation, the casings 106, 108, and 110 are successively installed in the well 100. After installation of the casings, the lower completion section 142 is run into the well 100 and deployed in the inner passage of the third casing 110. After installation of the lower completion section 142, the tubing string is installed above the lower completion section 142. The tubing string and lower completion section are installed such that the inductive coupler portions 126A-126F are aligned with inductive coupler portions 112A-112F.

The well operator can then use the surface controller 130 to perform various tasks with respect to the well 100. For example, the surface controller 130 is used to issue commands to various downhole electrical devices to activate the electrical devices. Also, the surface controller 130 can receive measurement data from various sensor assemblies downhole.

Figure 2:
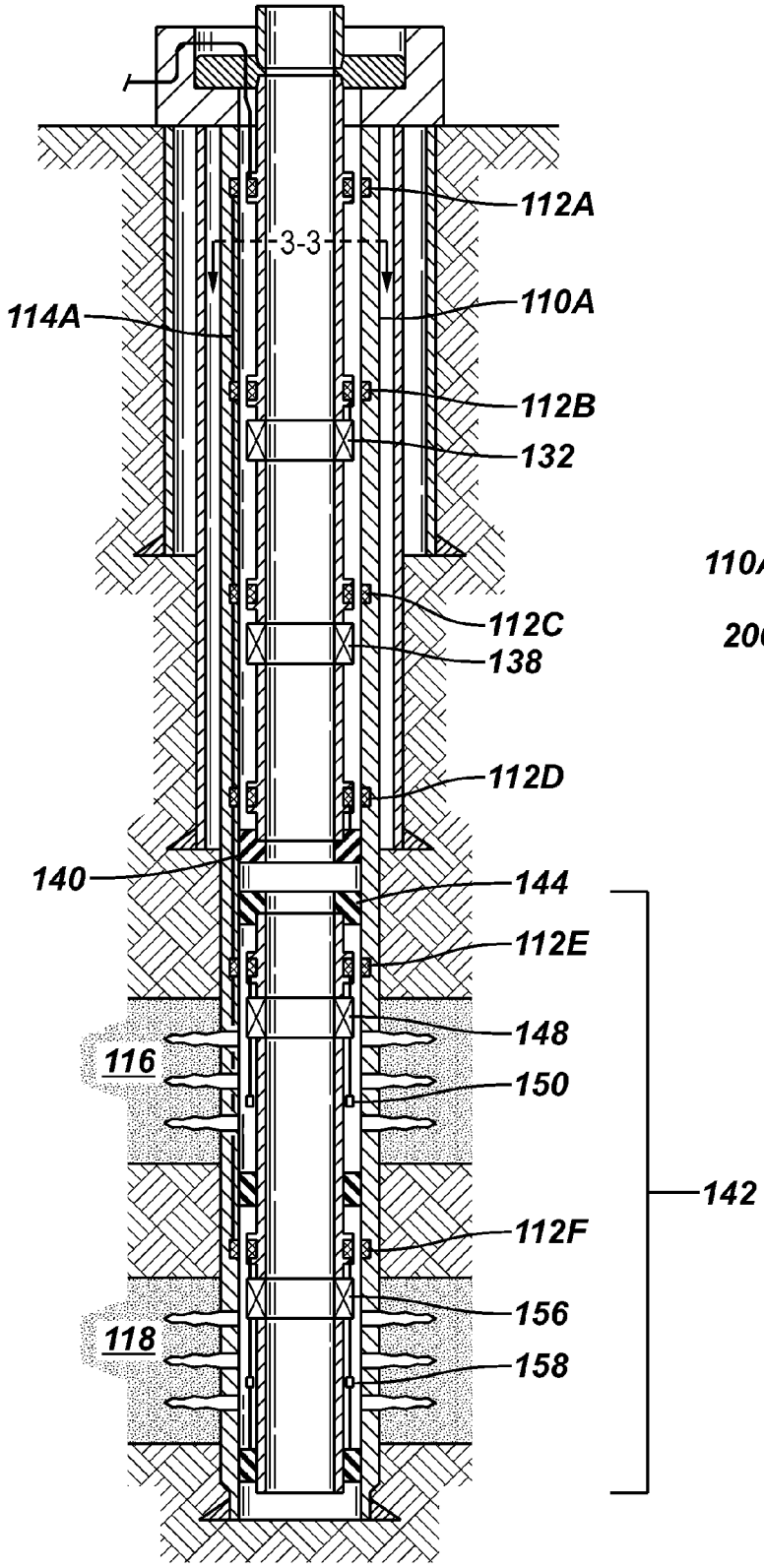
FIG. 2 illustrates a variant of the completion system of FIG. 2, according to another embodiment.

FIG. 2 illustrates a variant of the FIG. 1 embodiment, where instead of running the electric cable 114 outside the casing 110 (as in FIG. 1), an electric cable 114A is embedded in the housing of the third casing 110A (see FIG. 2). To embed the electric cable 114A in the housing of the third casing 110A, a longitudinal conduit that extends along the length of the third casing 110A is defined as part of the housing of the third casing 110A. The electric cable 114A is deployed in this conduit.

Figure 3:
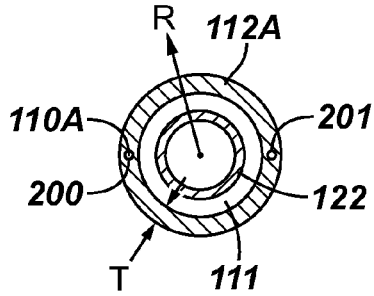
FIG. 3 is a cross-sectional view of a portion of the completion system of FIG. 2.

FIG. 3 shows a cross-sectional view of a section of the completion system depicted in FIG. 2, where a longitudinal conduit 200 embedded in the housing of the third casing 112A is illustrated. Note that the housing of the casing 112A has a thickness T, and the longitudinal conduit 200 is defined within this thickness T. The longitudinal conduit embedded in the housing of the casing 112A is offset (in a radial direction R) with respect to the inner passage 111 of the casing 112A. The conduit 200 can be referred to as an embedded longitudinal conduit.

Embedding the electric cable 114A in the housing of the third casing 112A provides further protection for the electric cable 114A from damage during deployment of the third casing 110A. The third casing 110A is referred to as a wired casing, since the electric cable 114A is an integral part of the third casing 110A. In another variation, additional longitudinal conduits (e.g., 201 in FIG. 3) can be embedded in the housing of the casing in which corresponding additional electric cables can extend.

In both the FIGS. 1 and 2 embodiments, the electric cable 114 or 114A is considered to be located outside the inner passage 111 of the casing 110 or 110A.

Figure 4:
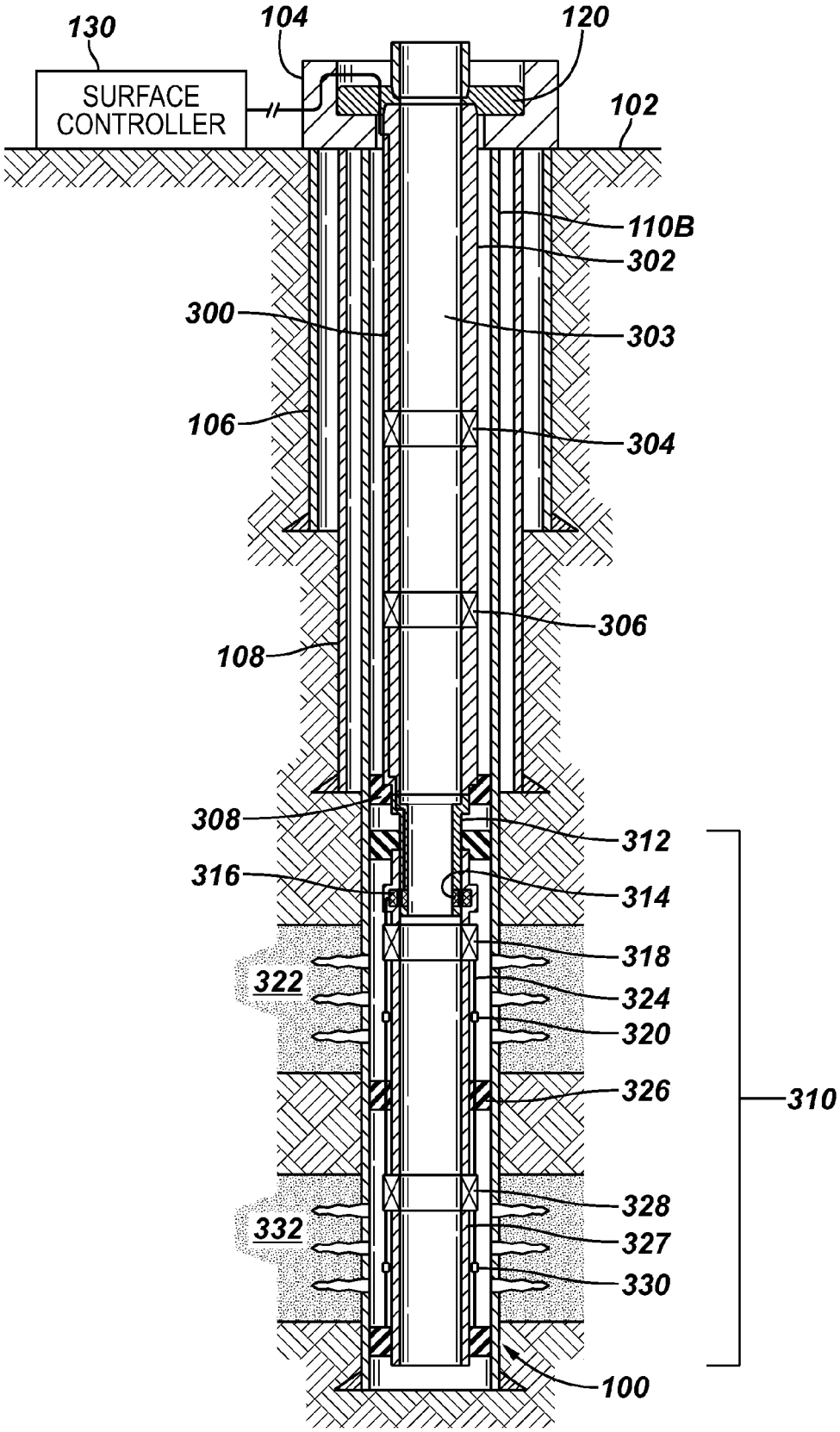
FIG. 4 illustrates a completion system that uses a wired tubing or pipe, according to yet another embodiment.

FIG. 4 shows an alternative embodiment in which an electric cable is embedded in a tubing string that is run inside a casing. According to FIG. 4, a third casing 110B that is run inside the second casing 108 does not have any inductive coupler portions (unlike the casing 110 or 110A in FIGS. 1 and 2, respectively). In other words, the third casing 110B is a regular casing that lines the third segment of the well 100. However, to provide electrical energy to electrical devices inside the third casing 110B, an electric cable 300 is provided in a longitudinal conduit that is embedded in a housing of a tubing 302. The tubing 302 provides an inner longitudinal bore 303 through which production fluids or injection fluids can flow. The tubing 302 enables the flow of production or injection fluids with the earth surface.

The tubing 302 is referred to as a wired tubing, since the electric cable 300 is embedded in the tubing 302. Although only one electric cable 300 is depicted, note that multiple electric cables can be provided in corresponding longitudinal conduits embedded in the housing of the tubing 302 in an alternative implementation.

The tubing 302 is attached to the tubing hanger 120, and the tubing 302 is deployed into the well 100 inside third casing 110B. At an upper part of the tubing 302, the electric cable 300 extends radially outwardly to exit the outer surface of the tubing 302. The electric cable 300 then extends upwardly through the tubing hanger 120 to the surface controller 130.

The tubing 302 has a safety valve 304 and a sensor assembly 306, both of which are electrically connected to the electric cable 300. In addition, the tubing 302 is connected to a production packer 308 that is also electrically connected to the electric cable 300.

The tubing 302 and the production packer 308 are part of a tubing string that forms a first part of the completion system of FIG. 4. The tubing string further includes a lower pipe section 312 that is attached below the production packer 308. The pipe section 312 has an inductive coupler portion 314, which can be a male inductive coupler portion. The completion system of FIG. 4 further includes a lower completion section 310 below the tubing string. The lower pipe section 312 of the tubing string is insertable into an inner passage of the lower completion section 310.

The electric cable 300 runs through the production packer 308 and through an inner conduit of the pipe section 312 to electrically connect the inductive coupler portion 314. The male inductive coupler portion 314, which is part of the tubing string, is positioned adjacent a second (female) inductive coupler portion 316, which is part of the lower completion section 310. The inductive coupler portions 314, 316 make up an inductive coupler to allow for coupling of electrical energy between electrical devices that are part of the lower completion section 310 and the electric cable 300 that runs inside the wired tubing 302.

The second inductive coupler portion 316 is electrically connected to a flow control valve 318 and a sensor assembly 320, both of which are part of the lower completion section 310. The flow control valve 318 and sensor assembly 320 are located in an upper zone 322. The electrical connection between the second inductive coupler portion 316 and the flow control valve 318/sensor assembly 320 is through an electric cable 324. The electric cable 324 further extends through an isolation packer 326 that is part of the lower completion section 310. The electric cable 324 extends to a flow control valve 328 and a sensor assembly 330, which are located in a lower zone 332. The lower completion section 310 further includes a sand control assembly 327 (e.g., a sand screen).

In operation, the surface controller 130 is able to control activation of the safety valve 304, sensor assembly 306, flow control valves 318, 328, and sensor assemblies 320, 330.

In some embodiments, the sensor assemblies 150, 158 (FIGS. 1, 2) and 320, 330 (FIG. 4) can be implemented with sensor cables (also referred to as sensor bridles). The sensor cable is basically a continuous control line having portions in which sensors are provided. The sensor cable is "continuous" in the sense that the sensor cable provides a continuous seal against fluids, such as wellbore fluids, along its length. Note that in some embodiments, the continuous sensor cable can actually have discrete housing sections that are sealably attached together. In other embodiments, the sensor cable can be implemented with an integrated, continuous housing without breaks. Further details regarding sensor cables are described in U.S. Patent Application entitled "Completion System Having a Sand Control Assembly, an Inductive Coupler, and a Sensor Proximate the Sand Control Assembly," Ser. No. 11/688,089, referenced above.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A completion system for use in a well, comprising:

a liner for lining the well, the liner having a first inductive coupler portion;

an electric cable extending outside an inner passage of the liner;

a second inductive coupler portion; and an electrical device inside the liner and electrically connected to the second inductive coupler portion, wherein the second inductive coupler portion is positioned proximate the first inductive coupler portion to enable power to be provided from the electric cable outside the inner passage of the liner to the electrical device inside the liner; and wherein the liner has a housing in which a longitudinal conduit is embedded, wherein the electric cable extends through the longitudinal conduit.

2. The completion system of claim 1, wherein the longitudinal conduit embedded in the housing is offset in a radial direction with respect to the inner passage of the liner.

3. The completion system of claim 1, further comprising at least another longitudinal conduit embedded in the housing of the liner, and another electric cable extending in the another longitudinal conduit.

4. A completion system for use in a well, comprising:

a tubing to provide flow of fluid to or from an earth surface from which the well extends, wherein the tubing has a housing defining a longitudinal bore embedded in the housing;

an electric cable in the longitudinal bore;

an electrical device for positioning in the well;

an inductive coupler to communicate electrical energy between the electric cable and the electrical device;

a tubing string including the tubing; and a lower completion section that is separate from the tubing string, wherein the inductive coupler comprises a first inductive coupler portion that is part of the tubing string, and a second inductive coupler portion that is part of the lower completion section.

5. The completion system of claim 4, wherein the tubing has a second electrical device that is electrically connected to the electric cable.

6. The completion system of claim 4, wherein the tubing string has a pipe section that includes a first inductive coupler portion, the pipe section insertable into an inner passage of the lower completion section to position the first inductive coupler portion adjacent the second inductive coupler portion.

7. The completion system of claim 6, wherein the lower completion section includes a sand control assembly.

* * * * *